United States Patent [19]

Blake

[11] Patent Number: 4,699,300

[45] Date of Patent: Oct. 13, 1987

[54] TWO PIECE DISPENSING CLOSURE WITH POSITIVE SHUTOFF

[76] Inventor: William S. Blake, 14 Georgetown Ct., Linwood, N.J. 08221

[21] Appl. No.: 4,820

[22] Filed: Jan. 12, 1987

Related U.S. Application Data

[63] Continuation of Ser. No. 791,423, Oct. 25, 1985, abandoned.

[51] Int. Cl.[4] ..... B65D 5/72

[52] U.S. Cl. ..... 222/494; 222/212; 222/481

[58] Field of Search ..... 222/206, 212–213, 222/215, 478–479, 481–485, 488, 494, 505, 516, 520, 544–545, 548, 567

[56] References Cited

U.S. PATENT DOCUMENTS

| | | | |
|---|---|---|---|
| 2,556,571 | 6/1951 | Bobbs et al. | 222/494 X |
| 3,203,603 | 8/1965 | Benson | 222/494 |
| 3,412,910 | 11/1968 | Hahn | 222/494 |
| 4,141,475 | 2/1979 | Nilson | 222/494 |
| 4,420,101 | 12/1983 | O'Neill | 222/212 |
| 4,474,314 | 10/1984 | Roggenburg, Jr. | 222/494 |
| 4,506,809 | 3/1985 | Corsette | 222/213 |

*Primary Examiner*—Joseph J. Rolla
*Assistant Examiner*—Michael S. Huppert
*Attorney, Agent, or Firm*—Dennis H. Lambert

[57] ABSTRACT

A self-closing two-piece dispensing closure for dispensing product from squeeze-type containers, in which a rigid closure member (11) is adapted to be secured to a container neck, and a flexible diaphragm valving member (14) is snap-fitted to the rigid member for relative rotation therebetween. The members have complementally shaped, concentrically disposed posts (18, 33) nested together and defining a valve seat (20) and valve lip (34) which opens to dispense product when the container is squeezed and closes automatically when pressure on the container is released. In one form of the invention, the member (11) has at least one port (23) therethrough near the base of the post (18) and the member (14) has a corresponding seal pad (25) projecting therefrom toward the member (11) and adapted to close the port (23) in one relative rotational position of the members to block product from the diaphragm (24), whereby the container may be shipped with product therein without danger of leakage in the event pressure is exerted on the container. The seal pad (25) effects a secure seal when in the closed position, and the location of the port (23) and seal pad (25) near the base of the posts (18, 33), together with the arrangement of the seat (20) and valve lip (34) at the outer or upper ends of the posts, assures a short and direct product flow path from the container to the point of dispensing, with virtually no residue at the end of a dispensing cycle.

13 Claims, 31 Drawing Figures

10

11

10

10'

TWO PIECE DISPENSING CLOSURE WITH POSITIVE SHUTOFF

This application is a continuation of application Ser. No. 791,423, filed Oct. 25, 1985, abandoned.

DESCRIPTION

1. Technical Field

This invention relates to container closures, and more particularly to dispensing closures for squeeze bottles. Such closures open to dispense product when the container is squeezed and automatically close when pressure is released from the container.

2. Background Art

In the packaging of various materials, ranging from personal care products such as shampoo, toothpaste, etc. to food products such as ketchup, cheese spreads and the like, many different package designs have evolved. All such packages are desirably capable of economical production in large quantities and also are preferably attractive in appearance and easy to use.

One popular package design is the squeeze bottle or flexible container which is squeezed to cause dispensing of the product. Such containers are provided with a variety of closures, including flip-up valves which must be manually opened and closed, and automatically operating valves which open when the container is squeezed and close when pressure is released from the container. The latter type closures are preferably provided with means for positively closing the valve to prevent accidental dispensing of product when the container is shipped, for example.

Exemplary of the automatically operating closures described above are the structures disclosed in U.S. Pat. Nos. 3,412,910, 4,141,475, 4,420,101 and 4,474,314. It will be noted that all of these designs are of essentially two-piece construction, comprising a flexible member which cooperates with a relatively rigid member to form the valve closure. Additionally, these patents all disclose means which may be operated to effect a positive closure of the container and prevent dispensing of the product even if the container is squeezed. This feature is important, for example, when the container is being shipped and inadvertent pressure may be applied to the container.

While the prior art designs are functional and are relatively economical to produce, they still suffer from one or more disadvantages. For example, some of the designs cannot be injection molded or at least require complicated molds. Other designs are relatively difficult to assemble, or require excessive pressure on the container to dispense the product, or present long tortuous passages for flow of the product, or have mold parting lines on critical surfaces due to their design. Other devices leave an excessive amount of residue, or are difficult to clean, or are of more than two pieces.

DISCLOSURE OF THE INVENTION

Applicant has discovered an improved dispensing closure for squeeze bottles, in which the closure automatically opens when the container is squeezed and automatically closes when the pressure is released from the container. Applicant's closure further has positive shut off means for preventing accidental dispensing of product when the container is inadvertently squeezed, as during shipping, for example, and has vent means which functions to admit air to the container to replace the volume previously occupied by product.

The dispensing closure in accordance with the invention is of two piece design, comprising a flexible member which cooperates with a relatively rigid member to provide the valving function. One of the members has at least one port therethrough and the other member has a sealing pad which may be brought into registry with the port to close the port and effect a positive shut off to prevent dispensing of product even if the container is squeezed. The two members are relatively rotatable in order to bring the pad into and out of registry with the port, as desired.

The use of sealing pads as described enables more effective sealing to be obtained when the parts are in their positively closed position, and when the parts are in their open position, i.e., the pads out of registry with the ports, the pressurized product is enabled to act upon the relatively large area of the flexible member, providing a hydraulic advantage for opening the closure whereby product may be dispensed without exerting inordinate pressure on the container. Further, the design of the components and the arrangement of the parts enables simple and economical molds of the straight draw type to be used, wherein there are no screw type cores and in which a smaller press can be used for a given number of parts as compared with prior art devices. Additionally, the design of the closure of the invention eliminates parting lines on critical surfaces, and enables changes in the diameter of the closure to be accomplished without changing the entire mold. The parts comprising the closure of the invention may be quickly and easily assembled by simply snapping them together. Similarly, they may constructed to snap-in or -over a container neck finish bead ring, or they may be configured to thread onto a container. Moreover, the container may be either injection blow molded or extrusion blow molded.

The coacting portions of the flexible and rigid members which form the valve closure are located relative to the position of the ports such that product flow from the container is over a relatively short path. Further, the valving portion is located at a position such that there is virtually no residue of product left around the valving area after a dispensing operation. In addition, the dispensing closure can be placed under a faucet or wiped clean with a cloth or napkin, if desired, to remove any residue which does remain.

BRIEF DESCRIPTION OF THE DRAWINGS

These and other objects and advantages of the invention will become apparent from the following detailed description and accompanying drawings, in which like reference characters designate like parts throughout the several views, and wherein.

BEST MODE FOR CARRYING OUT THE INVENTION

Figure 2:
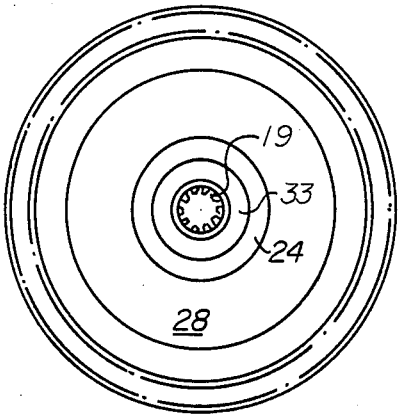
FIG. 2 is a top plan view of the assembly of FIG. 1.
Figure 4:
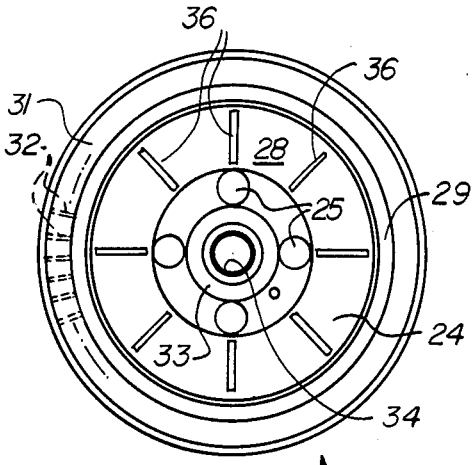
FIG. 4 is a bottom view of the flexible diaphragm of the assembly of FIG. 1.

Referring more specifically to the drawings, a two piece dispensing closure in accordance with the invention is indicated generally at 10 in FIGS. 1 through 5 and comprises an inner, rigid, ported closure member 11 which is adapted to be secured to the neck 12 of a container 13, and an outer, flexible diaphragm valving member 14 which is adapted to be secured to the rigid member 11.

The rigid member 11 comprises a disc-shaped wall 15 having a diameter slightly greater than the diameter of the neck 12, with a depending cylindrical wall or sleeve 16 adapted to extend downwardly in close-fitting relationship inside the neck of the container. A radially enlarged bead or rib 17 is formed on the outer surface of the sleeve 16 for snap-fitting engagement in a corresponding groove in the inner surface of the neck 12, whereby the rigid member may be quickly and easily snapfitted to the container. If desired, a false skirt 16' can be used as shown in dot-and-dash lines in FIG. 1, and a retention transfer bead on the neck 12 can be used. Moreover, it should be noted that with the construction shown, the neck finish on the container can be either injection or extrusion blow molded. An upstanding, frusto-conically shaped post 18 is formed centrally of the disc-shaped wall 15. The outer upper end surface of the post is longitudinally serrated at 19 for guiding and controlling the flow of product from the valve. For instance, the serrations may be shaped and sized to achieve a desired flow characteristic for a particular product or product viscosity. An annular lip seal 20 is formed on the outer surface of the post at the inner ends of the serrations for cooperation with the valving member to be described. An upwardly extending and slightly outwardly flared cylindrical wall 21 is formed on the outer peripheral edge of the disc-shaped wall 15, and has a diametrically enlarged bead or rib 22 on its upper, outer surface. A plurality of ports 23 (shown here as four in number) are formed through the disc-shaped wall 15 adjacent the base of the post 18 for flow of product from the container through the closure member 11.

Figure 5:
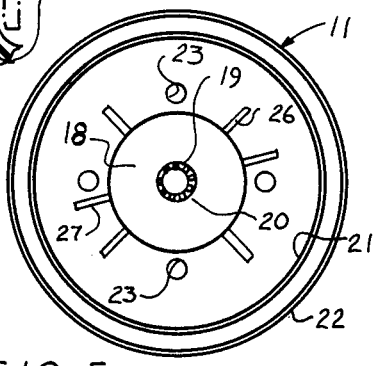
FIG. 5 is a top view of the rigid member of FIG. 4.
Figure 3:
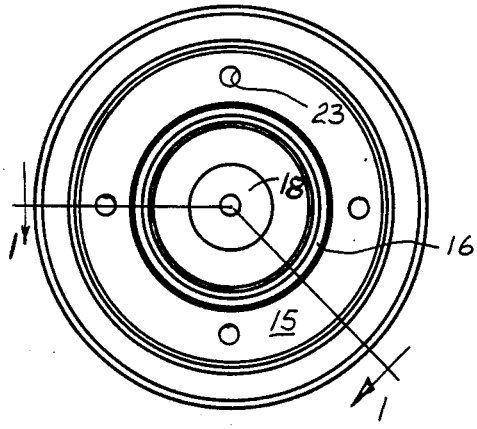
FIG. 3 is a bottom view of the assembly of FIG. 1.

The flexible diaphragm valving member 14 has a relatively narrow bottom annular wall 24 closely surrounding the base of the post 18, with a plurality of seal pads 25 (equal in number and spacing to the number and spacing of the ports 23 in the rigid closure) depending from the underside thereof in positions to overlie and close the ports in one position of the valving member and to expose and open the ports in another position of the valving member. As shown in FIG. 5, a plurality of indexing lugs 26 and 27 are formed on the upper surface of the rigid closure member in positions to be engaged by the seal pads to precisely define and limit opening and closing movement of the valving member. An upwardly and outwardly inclined wall or diaphragm 28 extends from the outer edge of the wall 24 and terminates at its upper end in a second relatively narrow annular wall 29 having an annular channel 30 formed on its underside for receiving the beaded upper end 22 of the rigid closure member 11, enabling the flexible diaphragm valving member to be rotated relative to the rigid closure member, but preventing relative axial movement therebetween. A short, outwardly flared skirt 31 is formed on the outer edge of the wall 29, depending downwardly over the wall 21 in surrounding relationship thereto. The outer surface of the skirt 31 may be serrated as at 32, if desired, to facilitate grasping of the flexible valving member to rotate it relative to the rigid member to open and close the seal pads with respect to the ports 23. An upstanding, frust-conically shaped valving lip or post 33 extends upwardly from the inner edge of the wall 24 in closely spaced concentric relationship with the post 18 and has a sealing lip 34 formed on its inner upper surface for sealing engagement with the lip seal surface 20 on the post.

Figure 1:
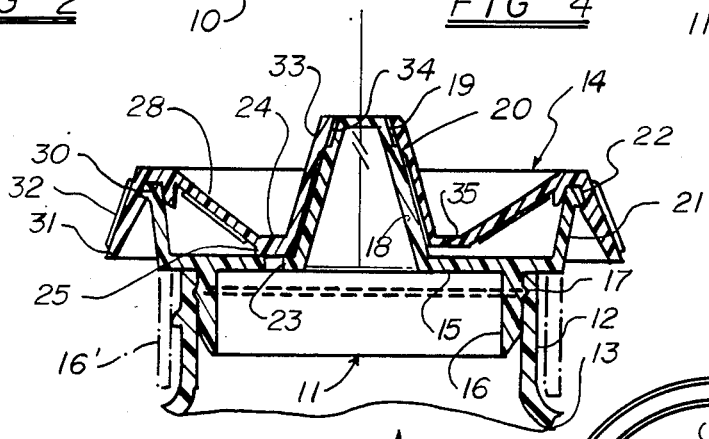
FIG. 1 is a sectional view in elevation of a first form of the invention, shown in place on the neck of a container, and is taken along line 1—1 in FIG. 3.

In use, the flexible valving member 14 is positioned as shown in the left-hand side of FIG. 1, with the seal pads disposed in overlying relationship with the ports 23, for storage and shipment. In this position, inadvertent pressure on the container (a flexible squeeze container) will not cause product to be dispensed because the relatively low surface area of the exposed parts of the seal pads through the ports 23 is not sufficient to enable the pressure on the contents of the container to overcome the natural bias of the diaphragm 28 and unseat the seal pads 25 from the ports 23. Thus, the sealing lip or valve 34 remains seated on the lip seal surface 20. When it is desired to dispense product from the container, the flexible member 11 is rotated approximately 45° from the closed position shown at the left of FIG. 1 to an open position as shown in the right-hand side of FIG. 1, with the seal pads 25 in engagement with the indexing stops or lugs 26. In this position, the seal pads are out of alignment with the ports 23 and squeezing of the container to pressurize the contents will result in product flowing through the ports 23 and into the space between the disc-shaped closure wall 15 and the diaphragm 28. The pressure of the product acting upon the relatively large area of the diaphragm produces a hydraulic advantage, which is sufficient to overcome the bias of the diaphragm and lift the sealing lip 34 from the seat 20, whereby product is enabled to flow from the container, through the ports 23 and thence outwardly through the space between the valving lip 33 and post 18, past the valve or sealing lip 34 and its seat 20 and to the point of use. Because of the large area of the diaphragm upon which the pressurized product acts, only a small force on the container is adequate to unseat the valve and permit dispensing of product. On the other hand, the small area of the seal pads 25 which are exposed through the ports 23 when the valve is in its closed position is inadequate to generate valve opening force even when substantial pressure is exerted on the container. Further, it will be noted that product flow occurs over a relatively short and straight-forward path from the container to point of use, and there is virtually no cavity or recess available for accumulation or collection of dispensed product after it passes the valve closure.

The annular wall 24 of the flexible valving member 11 also has one or more vent openings 35 formed therethrough to vent air into the product container at the end of a dispensing cycle to replace the volume of the dispensed product. These vent openings are very small so that product does not flow therethrough but, instead, flows upwardly through the frustoconical valving member. Additionally, a plurality of radially extending ribs 36 are formed in the diaphragm 28 to enhance the natural bias of the diaphragm and insure an effective valve closing action even after the diaphragm has been flexed a number of times over the expected life of the dispensing package.

The unique valving action of the invention thus enables the dispensing closure to be shipped on containers filled with product without danger of product leakage in the event pressure is placed on the container. Alternatively, the dispensing closure can be sold as a separate item for attachment by the consumer to a variety of different containers. The closure of the invention is also easier than most prior art closures to mold and assemble, and it can be designed for snap-fitting engagement with injection or extrusion blow molded neck ring finishes, or threaded engagement, as desired. Moreover, the closure can be given a number of proprietary design shapes and features, i.e., the false skirt, without impairing its function.

Figure 6:
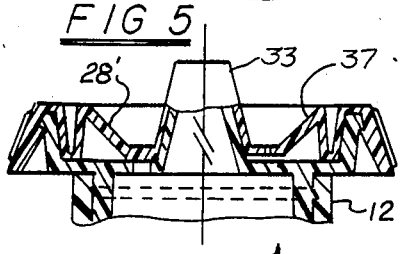
FIG. 6 is a sectional view similar to FIG. 1 of a first modification of the invention.
Figure 8:
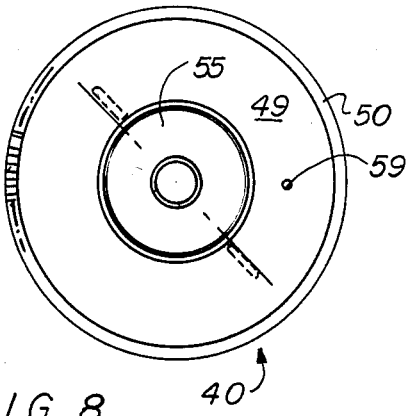
FIG. 8 is a top view of the assembly of FIG. 7.
Figure 10:
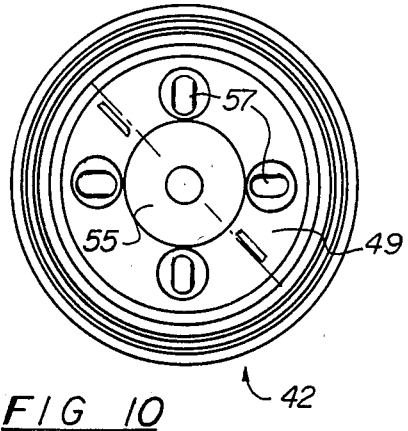
FIG. 10 is a bottom view of the outer rigid cap of the assembly of FIG. 7.
Figure 7:
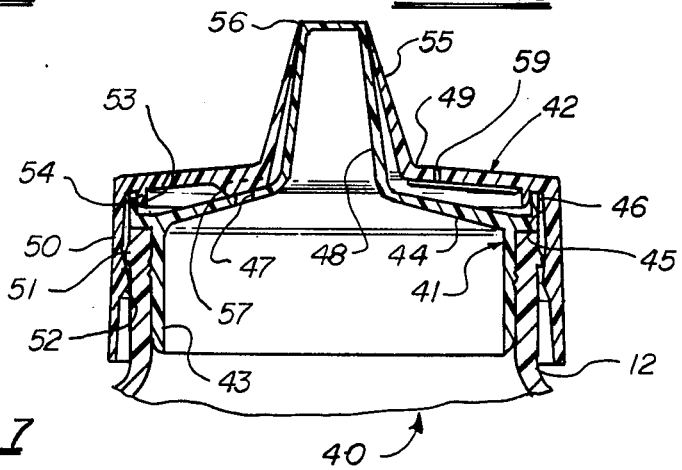
FIG. 7 is a sectional view similar to FIG. 1 of a second modification of the invention.
Figure 9:
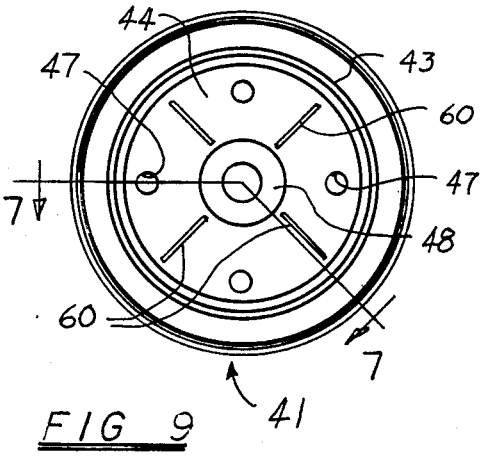
FIG. 9 is a bottom view of the assembly of FIG. 7.
Figure 11:
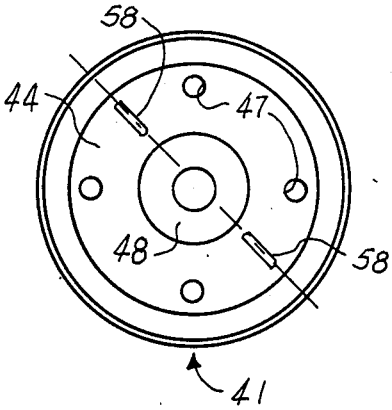
FIG. 11 is a top view of the flexible diaphragm of FIG. 7.
Figure 13:
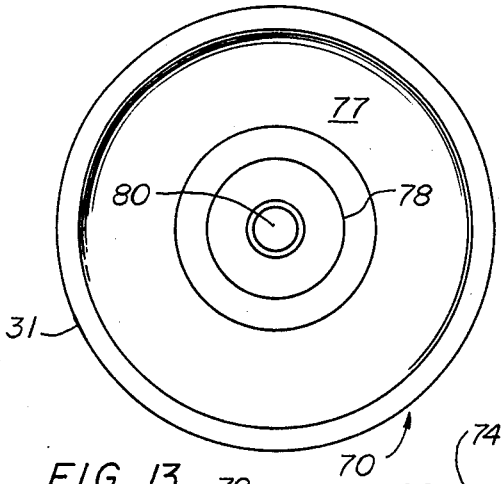
FIG. 13 is a top view of the flexible diaphragm of the assembly of FIG. 12.
Figure 15:
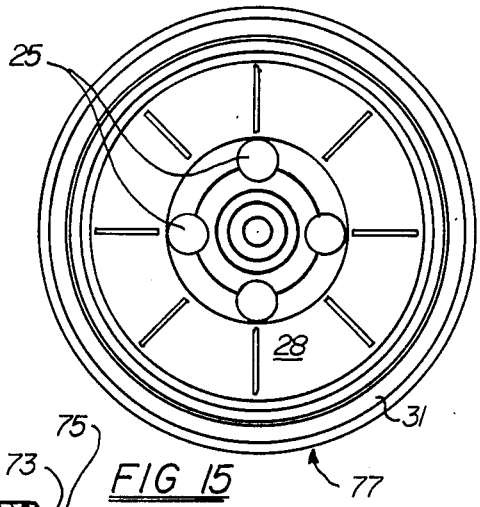
FIG. 15 is a bottom view of the flexible diaphragm of FIG. 12.
Figure 12:
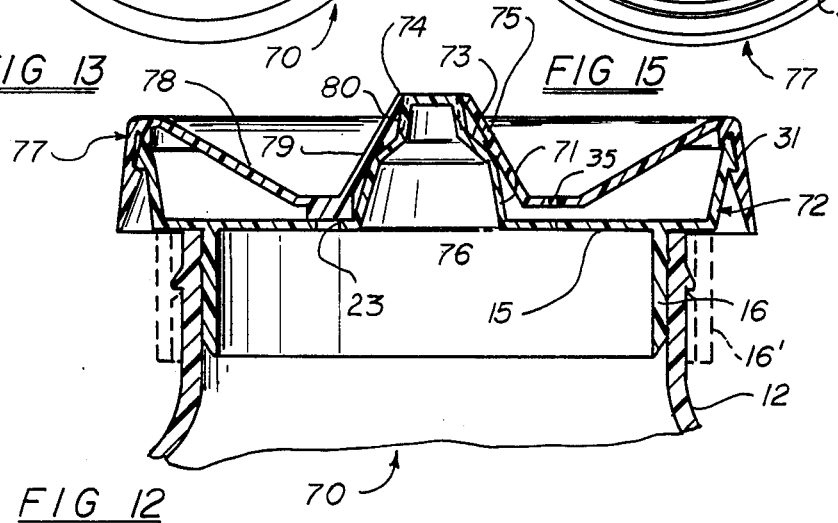
FIG. 12 is a sectional view similar to FIG. 1 of a third modification of the invention.
Figure 14:
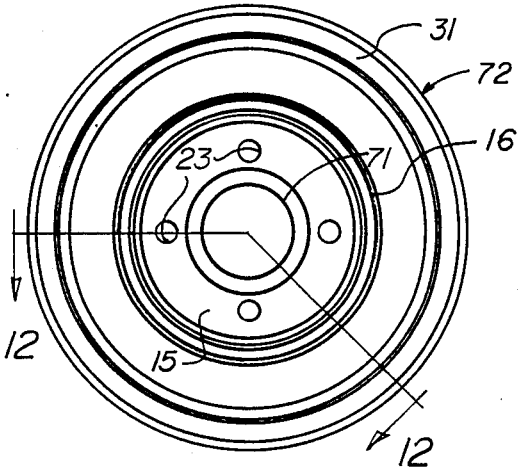
FIG. 14 is a bottom view of the rigid inner member of FIG. 12.
Figure 16:
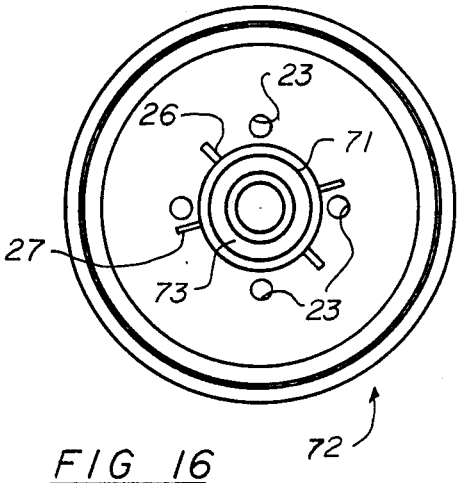
FIG. 16 is a top view of the rigid member of FIG. 12.
Figure 18:
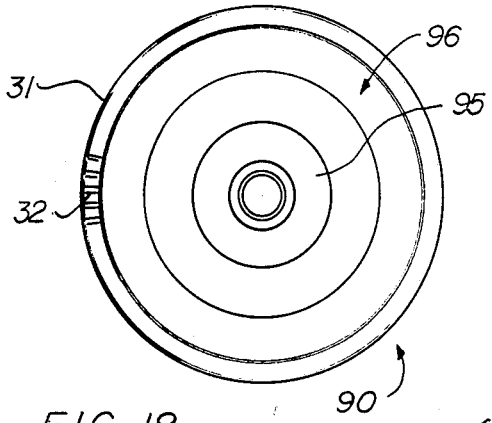
FIG. 18 is a top view of the flexible diaphragm of the form of the invention shown in FIG. 17.
Figure 20:
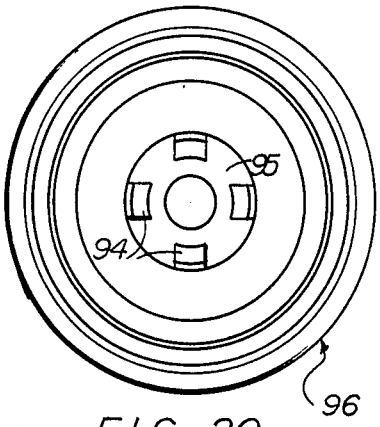
FIG. 20 is a bottom view of the flexible diaphragm of FIG. 17.
Figure 17:
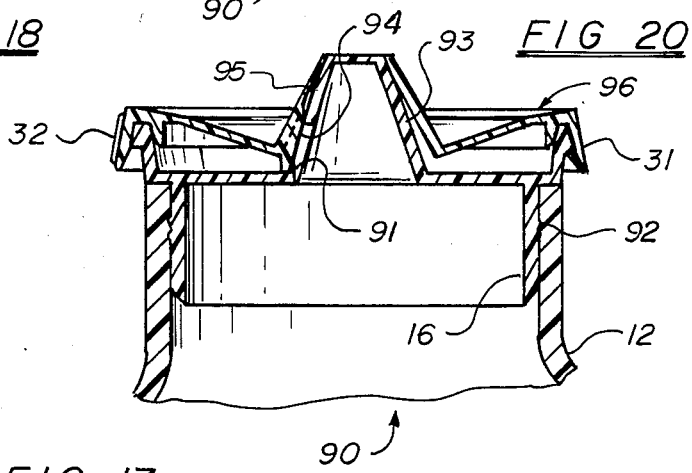
FIG. 17 is a sectional view similar to FIG. 1 of a fourth modification of the invention.
Figure 19:
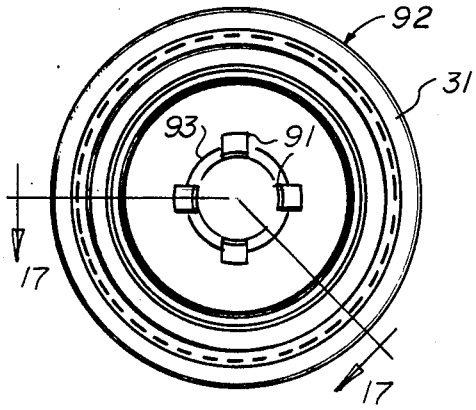
FIG. 19 is a bottom view of the assembly of FIG. 17, with the neck of the container omitted.
Figure 21:
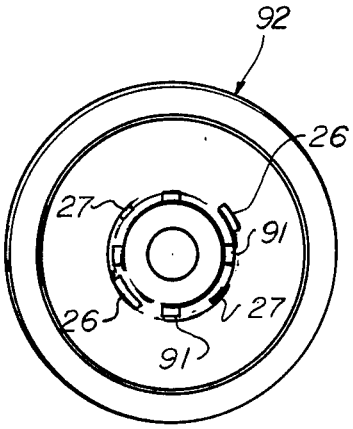
FIG. 21 is a top view of the rigid member of FIG. 17.
Figure 23:
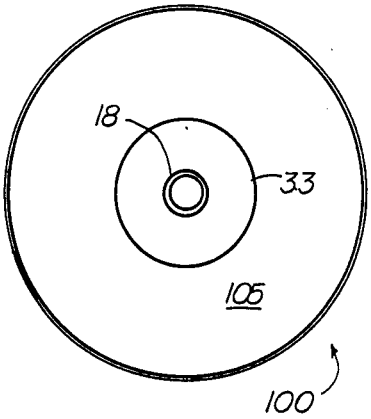
FIG. 23 is a top view of the outer flexible diaphragm of FIG. 22.
Figure 25:
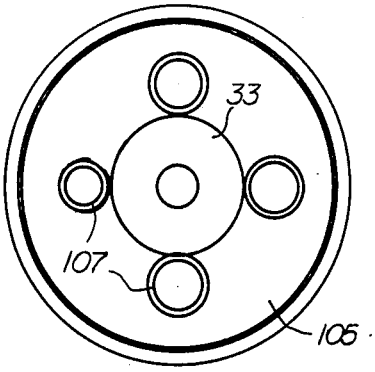
FIG. 25 is a bottom view of the flexible diaphragm of FIG. 22.
Figure 22:
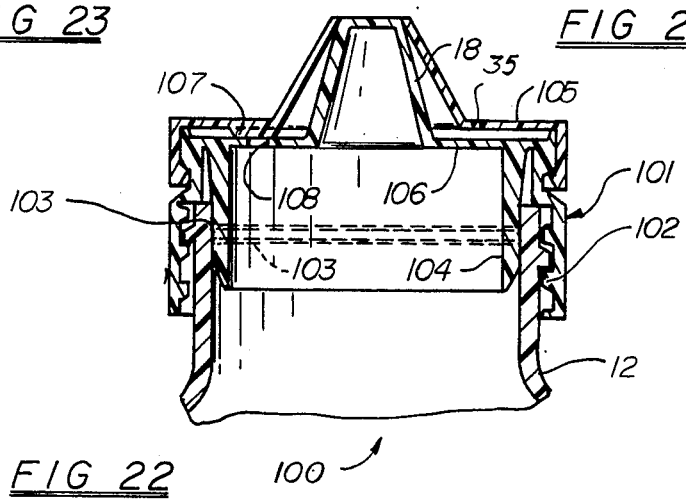
FIG. 22 is a sectional view similar to FIG. 1 of a fifth modification of the invention.
Figure 24:
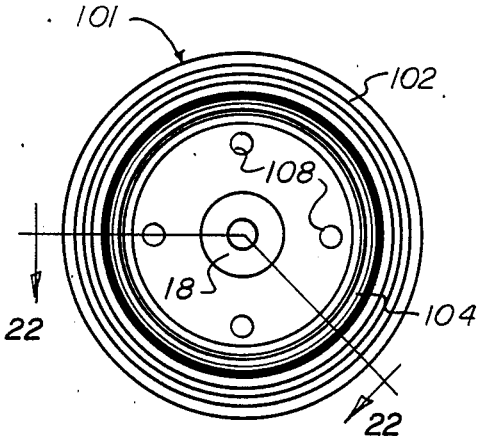
FIG. 24 is a bottom view of the inner, rigid member of FIG. 22.
Figure 26:
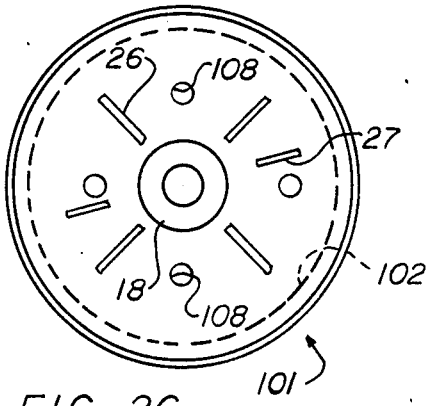
FIG. 26 is a top view of the rigid member of FIG. 22.
Figure 28:
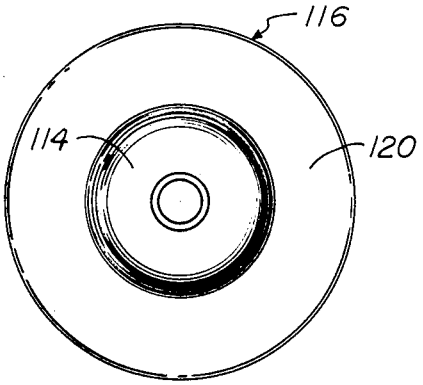
FIG. 28 is a top view of the outer, flexible diaphragm of FIG. 27.
Figure 30:
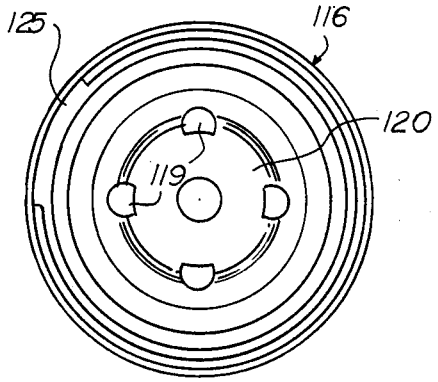
FIG. 30 is a bottom view of the flexible diaphragm of FIG. 27.
Figure 27:
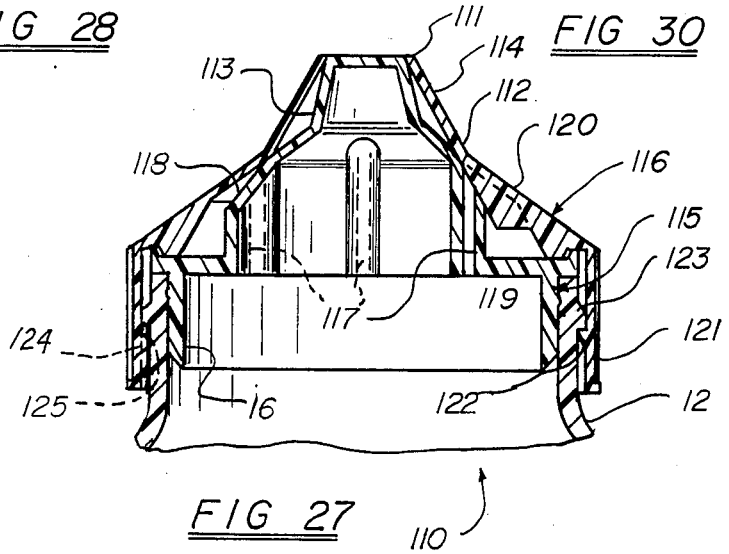
FIG. 27 is a sectional view similar to FIG. 1 of a sixth modification of the invention.
Figure 29:
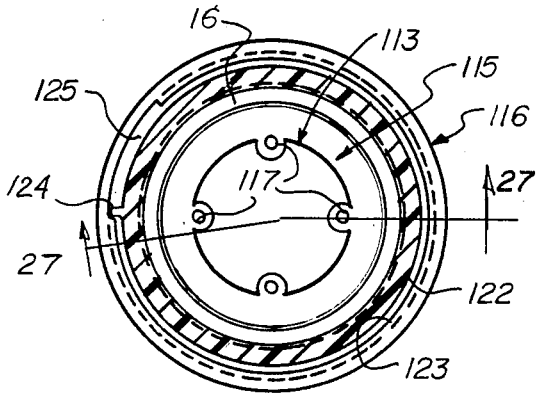
FIG. 29 is a a bottom view of the assembly of FIG. 27, with a partial section of the neck of the container, showing the indexing lug and cut-out.
Figure 31:
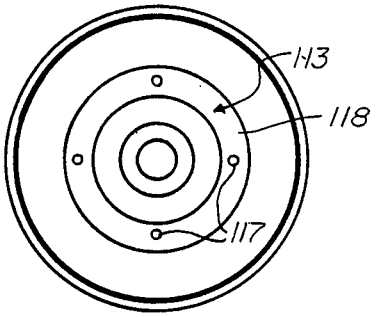
FIG. 31 is a top view of the inner, rigid member of FIG. 27.

A first modification of the invention is shown generally at 10' in FIG. 6, wherein the diaphragm 28' has a pleat 37 therein for effecting a bellows-like action. In all other respects, this form of the invention is identical to that previously described.

A second modification of the invention is shown generally at 40 in FIGS. 7 through 11, and in this form of the invention, the flexible diaphragm valving member 41 is disposed interiorly of the rigid closure member 42. The flexible valving member 41 has a depending cylindrical skirt 43 at the outer marginal edge of the diaphragm 44, adapted to extend in close-fitting relationship inside the neck ring of the container. A short annular flange 45 extends outwardly from the upper edge of the skirt in overlying relationship to the upper end of the container neck, and has an upturned annular flange 46 on its outer marginal edge. A plurality of ports 47 are formed through the diaphragm 44 for flow of product from the container and through the diaphragm. An upstanding, frustoconically shaped post 48 is formed in the center of the diaphragm 44 and defines a valving member as described hereinafter.

The rigid outer member 42 includes a substantially horizontal end wall 49 with a depending cylindrical skirt 50 extending downwardly over the container neck. Interengaged detents or rings 51 and 52 are formed on the inner surface of the skirt and the outer surface of the neck, respectively, for enabling relative rotational movement between the flexible valving member and the rigid outer member or cap but preventing axial movement therebetween. A short, depending annular flange 53 extends downwardly from the end wall 49 in closely inwardly spaced relationship to the skirt 50, and defines a channel 54 in which the upper end of the flange 46 is received. An upstanding, frustoconically shaped post 55 is formed in the center of the wall 49, having an open upper end 56 substantially coterminus with the upper end of the post 48 in the flexible member. The upper outer end surface of the post 48 normally engages the upper inner end surface of the post 55 to effect a valve closure against flow of product from the container. For shipping or positive shut-off, a plurality of seal pads 57 are formed on the underside of the wall 49 in positions to be selectively placed into and out of registry with the ports 47. Indexing lugs or ribs 58 are formed on the upper surface of the diaphragm 44 for cooperation with the seal pads 57 to limit the opening and closing movements of the rigid member relative to the flexible member.

As in the previous forms of the invention, vent openings 59 are formed through the dispensing closure, in this case through the rigid outer member, for admitting air to the container at the end of a dispensing cycle. Also, strengthening ribs 60 are formed on the diaphragm 44 for enhancing the valve sealing or closing effectiveness over the expected life of the dispenser closure.

In operation, this form of the invention functions similarly to the forms of invention previously described, except that when the seal pads 57 are disposed out of alignment with the ports 47 and the container is squeezed to force product through the ports and into the space between the diaphragm 44 and end wall 49, the force of the product causes the diaphragm to flex downwardly away from the rigid outer member or cap, unseating the post 48 from the post 55 and enabling product to be dispensed from the container. All of the advantages noted with the previous forms of the invention are also present in this form.

A third modification of the invention is shown generally at 70 in FIGS. 12 through 16, and this form is substantially identical to the first form shown in FIGS. 1 through 5, except that the post 71 in the center of the inner rigid member 72 has a stepped configuration, defining a shoulder 73 between the upper and lower ends thereof, whereby a pair of lip sealing surfaces 74 and 75 are provided on the post. Serrations 76 are formed in the outer surface of the post between the lip sealing surfaces to control and guide flow of product as described previously.

The post 78 of the outer flexible diaphragm valving member 77 similarly has a pair of lip seals or valving portions 79 and 80 formed thereon in positions to cooperate with the lip sealing surfaces on post 71 to effect plural serial sealing areas in addition to the positive closure provided by the seal pads. In all other respects, this form of the invention functions identically to the form disclosed in FIGS. 1 through 5.

A fourth modification of the invention is shown generally at 90 in FIGS. 17 through 21. This form of the invention is substantially identical to that disclosed in FIGS. 1 through 5, except that the product ports 91 through the rigid closure member 92 are formed in the base portion of the side wall of the post 93, rather than in the end wall of the closure, and the seal pads 94 are formed on corresponding inner side wall portions of the post 95 of the flexible diaphragm valving member 96. In all other respects, this form of the invention is identical to that disclosed in FIGS. 1 through 5.

A fifth modification of the invention is shown generally at 100 in FIGS. 22 through 26, and this form is similar to that shown in FIGS. 1 through 5 except that the rigid closure member 101 is threaded onto the neck of the container via threads 102, and a pair of seal rings 103 are formed on the skirt 104 of the rigid closure for sealing engagement with the inner surface of the neck of the container. Further, the flexible diaphragm 105 extends in overlying parallel relationship with the end wall 106 of the rigid member. Seal pads 107 on the underside of the diaphragm cooperate with ports 108 formed through the wall 106 to effect a positive shut-off of product flow in one rotational position of the flexible member relative to the rigid member. Otherwise, this form of the invention functions identically to that previously described in FIG. 1.

A sixth modification of the invention is shown generally at 110 in FIGS. 27 through 31, and this form is similar to that shown in FIGS. 12 through 16 in that plural serial sealing areas 111 and 112 are formed on the posts 113 and 114 of the rigid member 115 and flexible member 116, respectively. Further, the product ports 117 are defined by elongate passages formed in the side wall of the post 113, and the passages open upwardly through a sloping shoulder 118. Seal pads 119 are formed on the underside of the frustoconically shaped diaphragm 120 for cooperation with the ports to positively close them as for shipping, etc. In addition, the flexible diaphragm member 116 has a depending cylindrical skirt 121 with an annular bead or rib 122 formed on the inner surface thereof for cooperation with a corresponding rib 123 on the outer surface of the container neck to retain the dispensing closure on the container and yet permit rotation between the flexible member and the container and rigid member. As seen best in FIGS. 27, 29 and 30, an indexing lug or stop 124 is formed on the outer surface of the container neck, extending below the rib 123, for cooperation with a cut-out 125 formed in the rib 122 on the inner surface of the skirt 121. In all other respects, this form of the invention functions identically to that disclosed in FIGS. 12 through 16.

While the invention has been illustrated and described in detail herein, it is to be understood that various changes in construction and operation can be made without departing from the spirit thereof as defined by the scope of the claims appended hereto.

I claim:

1. A self-closing, two-piece dispensing closure, comprising:

a rigid closure member having means for attachment thereof to a container of product to be dispensed;

said rigid closure member having an upstanding post in the center thereof, said post defining a valve seat at its upper end;

a flexible diaphragm valving member supported in contiguous relationship to the rigid closure member for relative rotation therebetween but restrained against axial movement relative thereto;

said flexible diaphragm valving member having a diaphragm wall with an upstanding post-like valve means in its center extending in substantially concentric relationship to the post on the rigid member, said post-like valve means having a valve sealing lip at its upper end which is normally seated against the rigid member valve seat; and one of said rigid closure member and said flexible valving member having at least one product flow port therethrough and the other of said members having at least one seal pad projecting therefrom toward said one member to overlie and close said port in one rotational position of the members and to expose and open the port in another rotational position of the members, said seal pad, when closed, blocking flow of product from the container to the area between the rigid closure member and the diaphragm, said port and seal pad being disposed adjacent the base of the post whereby when the seal pad is away from the port product flowing through the port from the container acts on the diaphragm to provide a hydraulic advantage in opening the valve, said product flow path from the container and through the valve being relatively short and direct, and the projecting seal pad providing an effective and secure positive seal against flow of product through the port when the members are in said rotational position relative to one another.

2. A dispensing closure as in claim 1, wherein:

the axis of the port in said one member extends parallel to the axis of rotation of the members relative to one another, whereby the closure is easy to mold and the product flow path is direct.

3. A dispensing closure as in claim 2, wherein:

there are a plurality of ports and corresponding seal pads disposed around the axis of rotation.

4. A dispensing closure as in claim 3, wherein:

the members have snap-fitting means thereon for snap-fitting engagement of the members to one another and to a container.

5. A dispensing closure as in claim 2, wherein:

there are plural serially arranged valve seats and corresponding valve sealing lips on the posts.

6. A dispensing closure as in claim 1, wherein:

the product flow port and corresponding seal pad are disposed on the side walls of the respective posts.

7. A dispensing closure as in claim 3, wherein:

the flexible diaphragm valving member is disposed exteriorly of the rigid closure member, relative to the container.

8. A dispensing closure as in claim 3, wherein:

the flexible diaphragm valving member is disposed interiorly of the rigid closure member, relative to the container.

9. A dispensing closure as in claim 1, wherein:

there are a plurality of radially projecting reinforcing ribs on the diaphragm wall to insure firm closing action of the valve sealing lip on the valve seat throughout the expected life of the dispenser.

10. A dispensing closure as in claim 1, wherein:

there a plurality of cooperating indexing stops on the members to define the open and closed positions of the seal pad relative to the ports.

11. A dispensing closure as in claim 7, wherein:

the rigid closure member is secured to the container via complemental thread means on the container neck and on the rigid member.

12. A dispensing closure as in claim 6, wherein:

the rigid member post has a stepped configuration, defining a shoulder between the ends thereof, said ports opening through said shoulder; and said seal pads are carried by the flexible diaphragm valving member in positions to selectively open and close the ports upon relative rotation between the members.

13. A dispensing closure as in claim 1, wherein:

vent means is formed through said members to admit air to the container to replace dispensed product.

* * * * *